United States Patent [19]

Lisiecki

[11] 4,313,553

[45] Feb. 2, 1982

[54] CONTAINER WITH EXTENSIBLE POURING SPOUT

[75] Inventor: Robert E. Lisiecki, Orchard Lake, Mich.

[73] Assignee: Ex-Cell-O Corporation, Troy, Mich.

[21] Appl. No.: 193,328

[22] Filed: Oct. 2, 1980

[51] Int. Cl.[3] ..... B65D 5/74

[52] U.S. Cl. ..... 229/17 G

[58] Field of Search ..... 229/17 G, 48 R

[56] References Cited

U.S. PATENT DOCUMENTS

| | | | |
|---|---|---|---|
| 3,071,305 | 1/1963 | Zinn | 229/17 G |
| 3,074,610 | 1/1963 | Pugh | 229/17 G X |
| 3,120,335 | 2/1964 | Egleston et al. | 229/17 G X |
| 3,202,846 | 2/1967 | Wilcox | 229/17 G |
| 3,270,940 | 9/1966 | Egleston et al. | 229/17 G |
| 3,389,849 | 6/1968 | Egleston | 229/17 G |

*Primary Examiner*—Herbert F. Ross

*Attorney, Agent, or Firm*—John P. Moran

[57] ABSTRACT

The drawings and description disclose a container having the usual fold-in end panels and roof panels interconnected by front and rear sets of fold-back panels, with inner sealing rib panels extending vertically from the fold-back panels and confined between oppositely disposed outer sealing rib panels extending vertically from the roof panels, supplemented by fold-over lip panels attached to and folded over onto the inner sealing rib panels, serving to provide a stiffer spout to facilitate the opening process, while eliminating a raw edge on the pouring lip and greatly diminishing fiber tear and delamination of the pouring surface.

7 Claims, 9 Drawing Figures

CONTAINER WITH EXTENSIBLE POURING SPOUT

TECHNICAL FIELD

This invention relates generally to thermosplastic coated paperboard containers and, more particularly, to a blank and a container including a folded top end closure of an improved construction.

BACKGROUND ART

Containers for beverages such as milk, cream, other dairy products, juices, and the like are conventionally constructed from thermoplastic coated paperboard. One type of these containers includes a top end closure with a folded gable roof having a vertically projecting seal at the roof ridge for sealing the container and providing a readily available pouring spout when the contents of the container are to be dispensed.

Coated paperboard blanks for constructing such a container are made on converting machines similar to those disclosed by Monroe et al. U.S. Pat. No. 2,682,208 and Earp U.S. Pat. No. 3,731,600. After construction, the blanks are processed by forming, filling and sealing machines, such as those disclosed by Monroe et al. U.S. Pat. No. 3,303,761, Allen U.S. Pat. No. 3,918,236, Egleston Patent No. 3,398,659 or Young U.S. Pat. No. 4,193,833, to produce the formed, filled and sealed containers of the type referred to above and shown and described in Egleston et al. U.S. Pat. Nos. 3,270,940 and 3,120,335

While this type of container has been generally satisfactory, it is desirable to assure that the pouring spout thereof is capable of being readily opened and that fiber tear and delamination do not occur during or after the opening operation.

DISCLOSURE OF INVENTION

Accordingly, a general object of the invention is to provide a blank for a liquid-carrying container including improved top closure means for attaining the above desirable characteristics.

Another object of the invention is to provide an improved pouring spout arrangement for a liquid-carrying container.

A further object of the invention is to provide an improved container including a fold-over lip or panel formed on the usual pouring spout and adapted to being folded thereon so as to facilitate the opening process and to effectively eliminate delamination of the panels making up the pouring spout.

A still further object of the invention is to provide an improved blank for forming such a container.

Still another object of the invention is to provide a container having the usual fold-in end panels and roof panels interconnected by front and rear sets of fold-back panels, with inner sealing rib panels extending vertically from the fold-back panels and confined between oppositely disposed outer sealing rib panels extending vertically from the roof panels, supplemented by fold-over lip panels attached to and folded over onto the inner sealing rib panels, serving to provide a stiffer spout to facilitate the opening process, while eliminating a raw edge on the pouring lip and greatly diminishing fiber tear and delamination of the pouring surface.

Other objects and advantages of the invention will become more apparent when reference is made to the following description and accompanying drawings.

BEST MODE OF CARRYING OUT THE INVENTION

Figure 1:
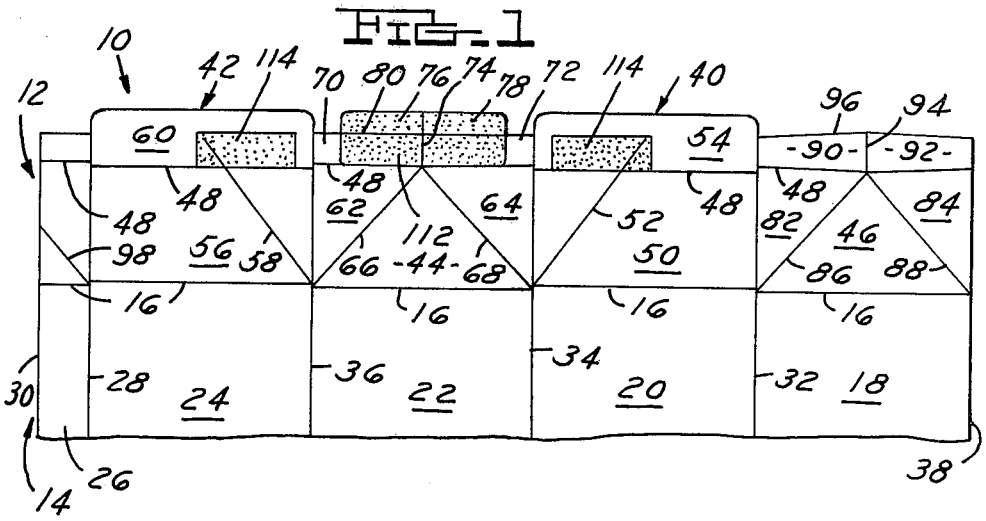
FIG. 1 is a fragmentary layout view of the inside surface of a coated paperboard container blank used to construct a container having a top end closure with a top seal and pouring spout arrangement in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a flat bottom end closure (not shown). The latter may be similar to that shown and described in Egleston et al. U. S. Pat. No. 3,120,335, and incorporated herein by reference. More specifically, a staggered lower top horizontal score line 16 extends transversely across the container blank 10 and separates the top end closure 12 and the body portion 14. Similarly, a bottom staggered horizontal score line (not shown) extends transversely across the container blank 10 and separates the bottom end closure (not shown) and the body portion 14. The body portion 14 comprises a plurality of integrally connected body panels, namely, a back panel 18, a side panel 20, a front panel 22 and a side panel 24, and a side seam flap or narrow fifth panel 26 formed adjacent the panel 24. The container blank 10 is defined on its longitudinal sides by its edges 28 and 30. The body panels 18, 20, 22 and 24, and the side seam flap 26, are defined by vertical score lines 32, 34, 36 and 38.

The top end closure 12 comprises roof panels 40 and 42. The panels 40 and 42 are connected integrally to the upper ends of the body panel members 20 and 24, respectively. A triangular gable or spout panel 44 and a triangular gable or closure panel 46 are connected integrally to the body panels 18 and 22, respectively. A staggered upper top horizontal score line 48 extends transversely from the blank edge 28 to the blank edge 30, substantially parallel to the horizontal score line 16.

The roof panel 40 is divided basically into two portions by the horizontal score line 48. A lower closure panel 50 is defined by the score lines 32 and 34. An opening assist score line 52 extends substantially from the intersection of the score line 16 and the score line 34 to a point on the score line 48 that is closer to the score line 34 than to the score line 32. An upper closure panel portion 54 of the outer roof panel 40 serves as a sealing panel, as will be explained.

The roof panel 42 is divided into two parts by the score line 48. The inner part of the roof panel 42 comprises a lower closure panel 56 which is defined by the horizontal score line 16 and 48 and the vertical score lines 36 and 38. An opening assist score line 58 extends from the intersection of score lines 16 and 36 to a point on the score line 48. The last mentioned intersection on the score line 48 is closer to the score line 36 than to the score line 38, and it is substantially the same distance from the score line 36 as the opening assist score line 52 is from the score line 34 along the score line 48. The roof panel 42 includes an upper closure panel 60 which is integral with the closure panel 56, and it is separated therefrom by the score line 48.

The triangular spout panel 44 is connected to a pair of inner roof or fold-back panels 62 and 64 by diagonal score lines 66 and 68, respectively. The fold-back panels 62 and 64 connect the triangular spout panel 44 to the closure panels 56 and 50, respectively. A pair of pouring panels or infold lips 70 and 72 are integrally connected to the foldback panels 62 and 64, respectively, and they are defined by a portion of the horizontal score line 48, the vertical score lines 36 and 34, and a vertical score line 74. As shown in FIG. 1, a pair of fold-over lips or panels 76 and 78 are connected by a score line 80 to the infold lips 70 and 72, respectively, and connected to each other by an extension of the vertical score line 74. The triangular base angles of the spout panel 44 are normally formed so as to be equal.

The triangular closure panel 46 is integrally connected to a pair of inner roof or fold-back panels 82 and 84 by diagonal score lines 86 and 88, respectively. The fold-back panel 82 integrally connects the triangular closure panel 46 to the closure panel 50. A pair of closure panels or infold lips 90 and 92 are connected to the fold-back panels 82 and 84, respectively, and they are defined at their lower ends by the score line 48 and at their outer edges by the score line 32 and the edge 28, respectively. The closure panels 90 and 92 are separated from each other by a vertical gable score line 94. The triangular base angles of the closure panel 46 are normally formed so as to be equal. The upper outer edge 96 of the closure panel 46 may be straight or formed as an inverted V-shaped edge. An additional diagonal score line 98 extends from the intersection of the score lines 16 and 38, across the side seam flap 26 to the edge 30 for cooperation with the diagonal score line 88 during the erection of the container.

Figure 2:
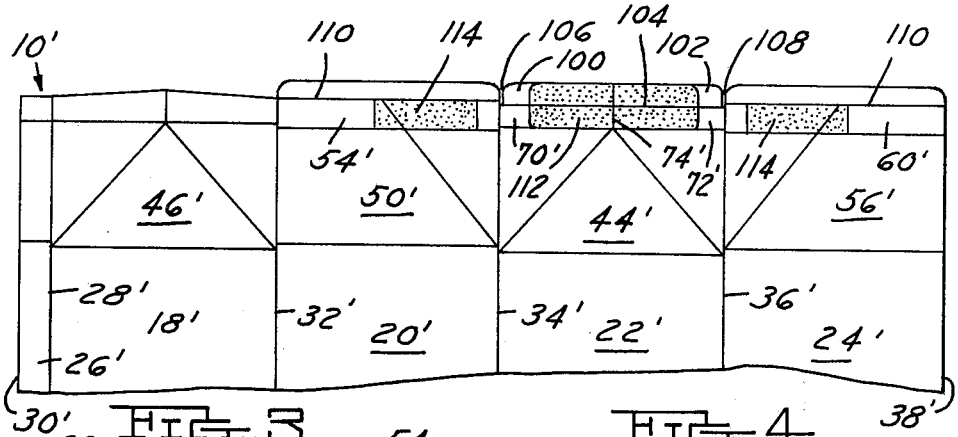
FIG. 2 is a fragmentary layout view of the inside surface of a modified form of blank from which a container embodying the invention may be erected.

Referring now to FIG. 2, there is shown an alternate embodiment to the container blank 10 of FIG. 1. In this arrangement, all references comparable to those of FIG. 1 include a prime (′). The side seam flap or fifth panel 26′ is formed adjacent the back panel 18′, rather than adjacent the side panel 24′. As illustrated, 28′ is a score line between the panels 18′ and 26′, and 38′ is a raw edge of the blank. Additionally, a pair of fold-over lips or panels 100 and 102 are connected to the infold lips 70′ and 72′ by a score line 104 and to each other by an extension of the vertical score line 74′. The fold-over lips 100 and 102, unlike the fold-over lips 76 and 78 of FIG. 1, extend laterally to the upper closure panels 60′ and 54′, respectively, from which they are separated by respective cut lines 106 and 108. It should be apparent that the fold-over panels 76/78 and 100/102 could be formed alternately on the blanks 10 and 10′. In either the FIG. 1 or FIG. 2 arrangement, a score line 110, shown in FIG. 2, may be formed across the upper closure panels 54 and 60 in order to enhance the folding of the latter panels in the manner shown in FIG. 6.

The container blank 10 illustrated in FIG. 1 is first formed into a side seam blank by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the edge 28 comes into contact with the outside surface of the side seam flap 26, and the edge 28 is positioned parallel and aligned with the vertical score line 38. The various members of the top end closure 12 and the bottom end closure will make similar movements. The container blank 10 is then sealed where the inside area of the body panel 18 comes into contact with the outside surface of the side seam flap 26.

In both the FIG. 1 and FIG. 2 structures, if desired, in the information of the side seam blank the side seam panel 26 could be sealed to the outside surface of the adjacent back panel 18 or side panel 24, respectively, rather than to the inner surface thereof as described above.

Figure 3:
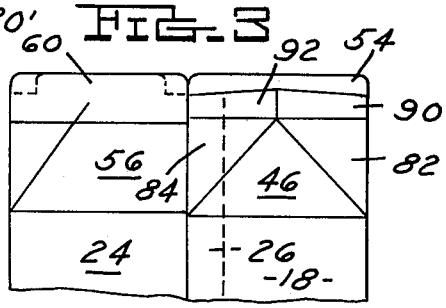
FIG. 3 is a fragmentary layout view of the outside surface of a container structure after it is side seamed from the container blank illustrated in FIG. 1.
Figure 4:
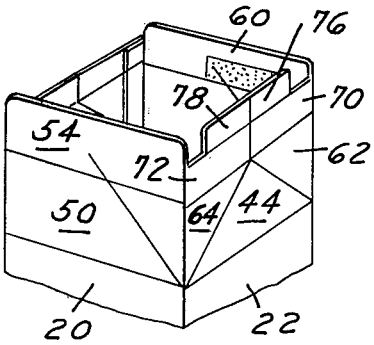
FIG. 4 is a fragmentary perspective view showing the side seamed container blank illustrated in FIG. 3 in an open ended top end view prior to the closing of the top closure structure of the present invention.
Figure 5:
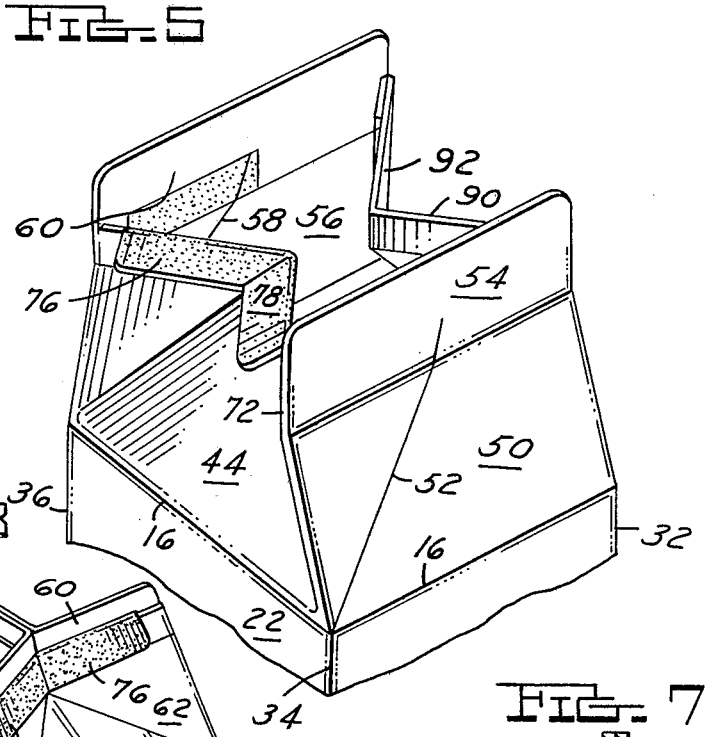
FIG. 5 is an enlarged fragmentary perspective view showing the container evolved from the side seamed blank of FIG. 3 in a partially closed condition.

After the side seam blank is opened up into a squared condition, the bottom end closure is formed and a product, such as milk or juice, is inserted in the container. Thereafter, the various parts of the top end closure 12 are folded about the various score lines in the following manner so as to form the top end structure. The fold-over lips 76 and 78 are folded around the score line 80 toward the outside surfaces of the infold lips 70 and 72, respectively. (If desired, this fold-over operation may be performed at an earlier stage in the process.) The triangular spout panel 44 is moved around the horizontal score line 16 over the end of the filled container and towards its center, as shown in FIG. 3. At the same time, the triangular closure panel 46 is moved toward the middle of the filled container around the horizontal score line 18. The once inside and now outside surfaces of the fold-over lips 76 and 78 will be rotated towards each other around the vertical score line 74, and the closure panels 90 and 92 will have their outside surfaces rotated towards each other around the vertical score line 94. The respective surfaces of the fold-over lip 72 and the closure panel 90 contact the sealing panel 54, while the respective surfaces of the fold-over lip 70 and the closure panel 92 contact the closure panel 60, as may be noted in FIGS. 5 and 6.

The sealing of the last mentioned elements of the top closure 12 is accomplished by conventional means, such as a sonic or high frequency vibration sealing means, such a seal providing a liquid tight seal, and yet being easily opened. The sealing of these various top end closure elements may also be accomplished by other means, such as gas heat, if desired.

Figure 7:
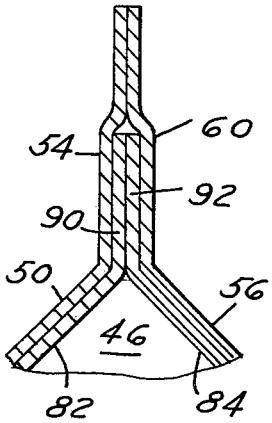
FIG. 7 is a fragmentary cross-sectional view, taken along a plane through the right end portion of the container of FIG. 5 as if the container were completely closed.
Figure 6:
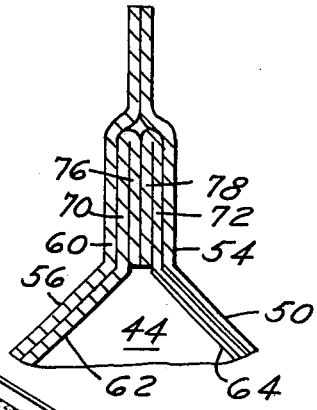
FIG. 6 is a fragmentary cross-sectional view, taken along a plane through the left end portion of the container of FIG. 5 as if the container were completely closed.

FIGS. 6 and 7 illustrate the positions of the various elements of the top end closure 12 once the sealing thereof has been effected, i.e., with the sealing panels 54 and 60 being disposed in a position perpendicular to a plane perpendicular to the side panels 18, 20, 22 and 24 to form a top seal.

The upper closure panels 54 and 60, which are secured to each other as shown in FIG. 6 by the above mentioned application of either high frequency vibration or heat techniques, may be prevented from forming a complete seal with the inner seal lip associated with the front triangular gable panel by applying an abhesive material in the well known manner to the fold-over lips 76 and 78 and adjacent portions of panels 70 and 72, as well as to portions of the laterally adjacent upper closure panels 50 and 54 and as shown by the shaded areas 112 and 114. This abhesive coating may be made of any suitable material, such as a silicone based material, that prevents complete sealing between different portions of the container and permits the sealed top end closure to be more easily opened from its closed condition for FIG. 6 through the step shown in FIG. 8 to its open condition of FIG. 9 where the pouring spout is provided.

INDUSTRIAL APPLICABILITY

Figure 8:
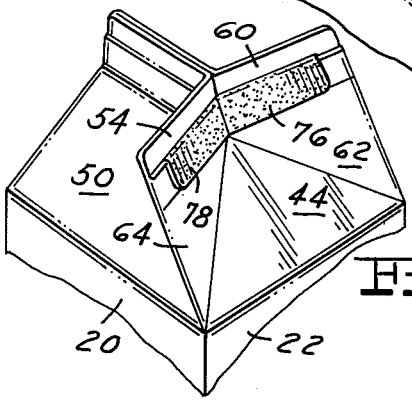
FIG. 8 is a fragmentary perspective view showing the container after the seal of FIGS. 5 and 6 is broken, and with the pouring spout in an intermediate step of the opening process.
Figure 9:
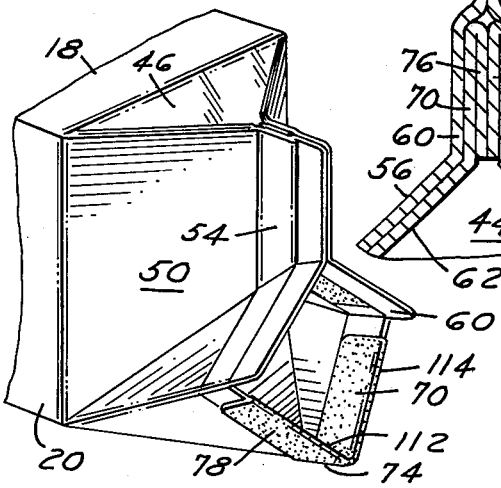
FIG. 9 is a fragmentary perspective view showing the container of FIG. 8 after the pouring spout has been fully opened.

Tests have shown that the fold-over lips 76/78 (FIG. 1) and 100/102 (FIG. 2) not only enhance the opening process of the pouring spout, by virtue of providing a "snap-open" characteristic from the condition substantially as shown in FIG. 8 to the condition shown in FIG. 9 due to the stiffer resultant lips, but that they also prevent fiber tear upon opening and delamination and discoloration of the pouring spout edges 112 and 114 (FIG. 9) resulting from frequent pouring usage, bu virtue of having eliminated the raw edge which heretofore has existed on conventional paperboard liquid carrying containers.

It should also be noted that the fold-over lips 76/78 and 100/102 are obtained without additional cost in that they are formed in what had heretofore been a scrap or cutout area. It should also be apparent that such lips could be added to both ends of the container top to facilitate the sealing operation, in that the top seal would have a constant thickness along its entire length.

While but two embodiments of the invention have been shown and described, other modifications thereof are possible.

The embodiments of the invention in which an exclusive property or privilege is claimed are defined as follows:

1. A top closure arrangement for a container having a four-sided body portion, said top closure arrangement comprising:

(a) first and second triangular gable panels extending from two oppositely disposed sides of said body portion, (b) first and second lower closure panels extending from the other two oppositely disposed sides of said body portion, (c) first and second sets of fold-back panels interconnecting said respective first and second triangular gable panels and lower closure panels, and being folded against the latter, (d) first and second upper closure panels extending vertically from said respective first and second lower closure panels, (e) first and second infold lips extending from each of said respective first and second sets of fold-back panels and being folded toward one another and sealed between said first and second upper closure panels, and (f) first and second fold-over lip panels extending from one set of said respective first and second infold lips and being folded over onto the latter, and folded and sealed against one another between said one set of first and second folded infold lips.

2. A container comprising:

(a) four interconnected body panels and a bottom closure therefor, (b) a triangular fold-in spout panel formed on the upper end of one of said body panels, (c) a triangular fold-in closure panel formed on one end of a second of said body panels, (d) first and second oppositely disposed lower closure panels, (e) first and second sets of triangulr fold-back panels interconnecting said spout panel and said closure panel with said respective lower closure panels, and being folded against the latter, (f) first and second upper closure panels extending vertically from said respective first and second lower closure panels, (g) first and second infold lips extending vertically from each of said respective first and second sets of gable panels and being folded toward one another and sealed between said first and second upper closure panels, and (h) first and second interconnected fold-over panels extending from one set of said respective first and second infold lips and being folded over onto the latter and sealed thereagainst, and folded and sealed against one another between said one set of first and second folded infold lips.

3. The container described in claim 2, wherein said first and second fold-over panels are narrower than said one set of first and second infold lips.

4. The container described in claim 2, wherein said first and second fold-over panels are substantially the same width as said one set of first and second infold lips.

5. The container described in claim 2, and including a first abhesive pattern formed on the inner surfaces of each of said first and second fold-over panels and a second abhesive pattern formed on said one set of first and second infold lips.

6. The container described in claim 5, and including a third abhesive pattern formed on the inside surface of each of said first and second upper closure panels directly opposite said abhesive pattern on said first and second infold lips, such that a pouring spout may be formed by manually separating said panels bearing abhesive patterns.

7. A blank for constructing a container, the blank comprising:

(a) body panels including front and back panels and a pair of side panels, (b) first and second oppositely disposed triangular gable panels connected to the top ends of said front and back panels, (c) first and second oppositely disposed lower closure panels connected to the top ends of said side panels, (d) first and second sets of fold-back panels interconnecting said respective first and second triangular gable panels and lower closure panels, and being folded against the latter, (e) first and second upper closure panels connected to said respective first and second lower closure panels, and having a first abhesive pattern selectively formed on each inner surface thereof, (f) first and second infold lips connected to each of said respective first and second sets of fold-back panels and adapted to being folded toward one another between said first and second upper closure panels, and having a second abhesive pattern formed on the inside surfaces of one set of said first and second infold lips so as to be directly opposite said first abhesive patterns once the blank is folded, and (g) first and second fold-over lip panels connected to one set of said respective first and second infold lips and having a third abhesive pattern formed on each inner surface thereof, said fold-over lip panels adapted to being folded over onto said one set of first and second infold lips, as well as being folded and sealed against one another between said one set of first and second infold lips.

* * * * *